US010383410B2

(12) United States Patent
Rittenhouse

(10) Patent No.: US 10,383,410 B2
(45) Date of Patent: Aug. 20, 2019

(54) WATCH STRAP

(71) Applicant: Kelly Rittenhouse, White Bear Lake, MN (US)

(72) Inventor: Kelly Rittenhouse, White Bear Lake, MN (US)

( * ) Notice: Subject to any disclaimer, the term of this patent is extended or adjusted under 35 U.S.C. 154(b) by 0 days.

(21) Appl. No.: 15/803,419

(22) Filed: Nov. 3, 2017

(65) Prior Publication Data

US 2018/0132574 A1 May 17, 2018

Related U.S. Application Data

(60) Provisional application No. 62/422,935, filed on Nov. 16, 2016.

(51) Int. Cl.
*A44C 5/00* (2006.01)

(52) U.S. Cl.
CPC ..... *A44C 5/0053* (2013.01)

(58) Field of Classification Search
CPC ..... A45F 2005/008; A45F 5/00; A44C 5/14; A44C 5/0053; A44C 5/0007
USPC ..... 224/152, 164–180, 219, 222; 24/265 WS
See application file for complete search history.

(56) References Cited

U.S. PATENT DOCUMENTS

| | | | | |
|---|---|---|---|---|
| 3,148,810 | A * | 9/1964 | Feldman | A44C 5/0053 224/164 |
| 4,575,833 | A | 3/1986 | Bakhtiari | |
| 9,095,311 | B2 * | 8/2015 | Hidai | A44C 5/0069 |
| 2003/0026171 | A1 | 2/2003 | Brewer et al. | |
| 2003/0099163 | A1 * | 5/2003 | Yang | A44C 5/0053 368/281 |
| 2009/0193675 | A1 * | 8/2009 | Sieber | A41H 1/02 33/759 |
| 2012/0083674 | A1 | 4/2012 | Hidai et al. | |
| 2016/0174674 | A1 * | 6/2016 | Oberpriller | A45F 5/021 224/222 |

OTHER PUBLICATIONS

"Internationai Application Serial No. PCT/US2017/059974, International Search Report dated Jan. 12, 2018", 3 pgs.
"International Application Serial No. PCT/US2017/059974, Written Opinion dated Jan. 12, 2018", 6 pgs.

* cited by examiner

*Primary Examiner* — Adam J Waggenspack
(74) *Attorney, Agent, or Firm* — Schwegman Lundbreg & Woessner, P.A.

(57) ABSTRACT

A strap for a wrist-worn article comprises a strapping structure including an inner surface and one or more coupling portions configured for coupling to a housing of the wrist-worn article. At least a portion of the strapping structure is configured so that the inner surface forms a frustoconical or substantially frustoconical contour corresponding to a generally frustoconical portion of an arm of a user when the one or more coupling portions are coupled to the housing.

8 Claims, 4 Drawing Sheets

WATCH STRAP

CLAIM OF PRIORITY

This application claims the benefit of priority to U.S. Provisional Application Ser. No. 62/422,935, filed on Nov. 16, 2016, entitled "A BETTER FITTING WATCH OR WEARABLE (FITNESS-TRACKER) STRAP, BAND OR BRACELET," the disclosure of which is incorporated herein by reference in its entirety.

BACKGROUND

Straps or bands have been used to hold watches to a wearer's arm, also referred to as wristwatches, for over 150 years and have been widely used since World War I. More recently, electronic devices such as pedometers, fitness trackers, exercise watches, and "smart" devices that connect to the Internet, such as through a smartphone, have started to be used widely. In particular, wrist-worn versions of these types of devices have become quite popular. These wrist-worn devices are also held to a wearer's arm with a strap or band that is similar if not identical to the conceptual design that has been used on wristwatches for over a century.

A typical design for the strap on a wristwatch or fitness tracker includes a pair of strap sections that are connected to opposing sides of a housing or case of the device on a first end of the strap section. Typically, the second end of one strap section is connected to the other strap section at or near its second end. Both strap sections are straight when the strap is laid flat, such that when the device is strapped onto the wearer's arm, the resulting strap generally forms the shape of a right cylinder or toroid that is wrapped around a wearer's arm.

SUMMARY

The present disclosure describes a strapping structure, also referred to simply as a "strap," for a wrist-worn article, such as a wristwatch or a wrist-worn fitness-tracking device. The strap includes at least a portion of its length that is arcuate relative to a central axis of the wrist-worn article's main housing when the strap is laid flat. When the strap is wrapped around a wearer's arm at or near the wrist, an inner surface of the strap has a generally frustoconical contour shape corresponding to a portion of the outer surface of the wearer's arm, which also has a generally frustoconical contour shape. The contour shape of the strap inner surface on the strap of the present disclosure is a better match to the contour shape of the arm outer surface compared to conventional straight watch straps, which form a generally cylindrical inner surface contour shape. In some examples, the contour shape of the inner surface of the strap substantially corresponds to or substantially matches the contour shape of the arm's outer surface. The better matching of the generally frustoconical inner surface of the strap with the generally frustoconical outer surface of the wearer's arm leads to a more comfortable fit compared to a conventional straight strap.

The inventor has recognized, among other things, that a problem to be solved can include the fact that generally cylindrical or toroidal shape that results from conventional straight straps are strapped to a human arm, which has a general frustoconical shape, i.e., the arm at or near the wrist. The placing of a generally cylindrically- or toroidally-shaped strapping structure onto the generally frustoconically shaped arm can result in uneven pressure distribution or pinch points, or both, on the wearer's arm or wrist. The present subject matter described herein can provide a solution to this problem, such as by providing a final strap structure that is also generally frustoconical in shape and that will more naturally follow or match the generally frustoconical contour of the wearer's arm. This more natural contoured fit, in turn, can reduce the likelihood of uneven pressure distribution and pinching. Therefore, the present subject matter described herein can provide for a better-fitting strap for wrist-worn articles that is more comfortable for the wearer.

The inventor has also recognized that a problem to be solved can include the fact that the pinching described above has led to wearers choosing a size setting that is larger than what may be optimal so that the strap does not uncomfortably pinch or otherwise pressure the wearer's arm. However, this larger-than-optimal sizing results in the wrist-worn article not being snugly secured to the wearer's arm, leading to the wrist-worn article sliding up or down the wearer's arm during use. The present subject matter described herein can provide a solution to this problem because, as noted above, the strap structure formed according to the subject matter described herein provides a more natural and comfortable fit to the wearer's arm with minimized pinching even when the strap is set to be tight against the wearer's arm.

The inventor has also recognized that a problem to be solved can include the fact that the generally cylindrical shape of conventional straight straps limits customization of conventional straps to fit a wearer's particular arm geometry, other than crude tightness adjustment to set the inner circumference of the strap. Different people might have different forearm shapes that can result in a noticeably different fit and feel of a strap, even between people with substantially the same nominal wrist size. The subject matter described herein can provide a solution to this problem by allowing a wrist-worn article manufacturer or a third-party strap manufacturer to make different strap models for different forearm geometries. In some examples, a particular strap can be custom made for the end wearer of the wrist-worn article, i.e., by determining a custom strap curve shape or size for that wearer based on one or more parameters of the wearer's wrist or forearm.

This summary is intended to provide an overview of subject matter of the present patent application. It is not intended to provide an exclusive or exhaustive explanation of the invention. The detailed description is included to provide further information about the present patent application.

BRIEF DESCRIPTION OF THE FIGURES

The drawings illustrate generally, by way of example, but not by way of limitation, various embodiments discussed in the present document.

DETAILED DESCRIPTION

Figure 1:
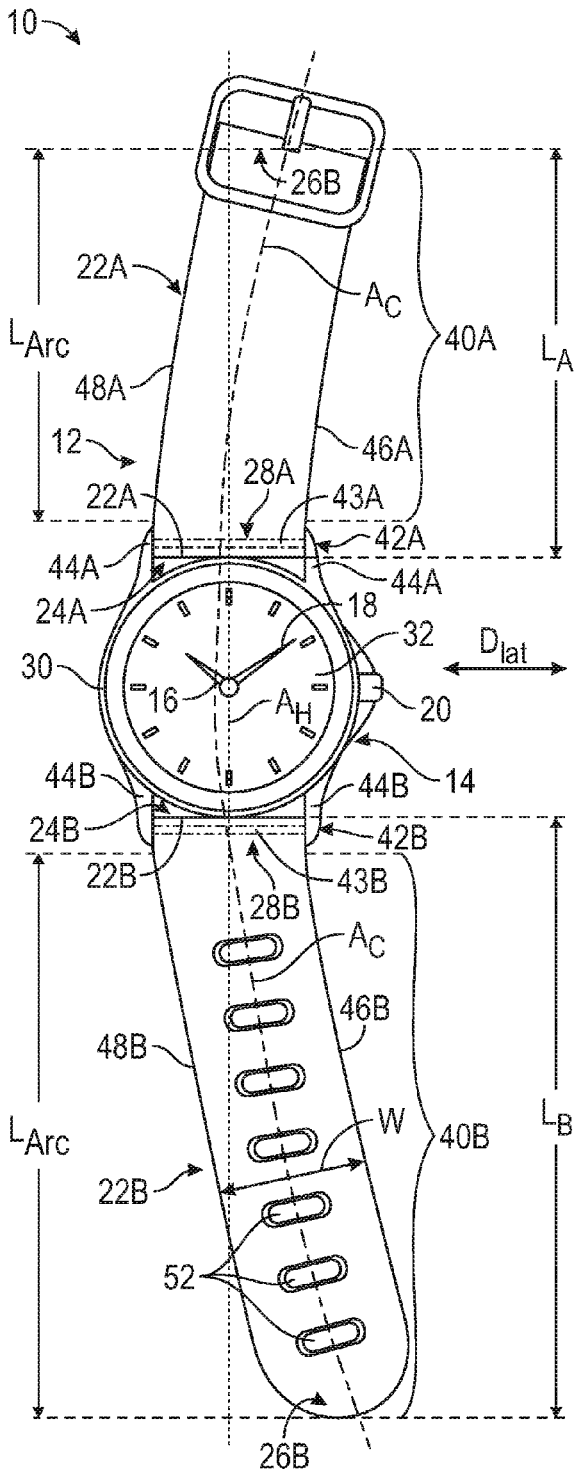
FIG. 1 is top plan view of an example wrist-worn article with an example of an arcuate strap connected to a housing of the wrist-worn article.

The following Detailed Description includes references to the accompanying drawings, which form a part of the present disclosure. The drawings show, by way of illustration, specific embodiments of wrist-worn articles, such as wristwatches, fitness-tracking devices, and the like, and straps or other securing structures that can be used to secure a wrist-worn article to the arm of a user, who will be referred to herein after as the "wearer." These embodiments, which are also referred to herein as "examples," are described in enough detail to enable those skilled in the art to practice the invention. It is to be understood that the specific examples shown and described herein can be combined. Moreover, aspects of other embodiments may be combined or substituted for certain aspects of the embodiments described herein, even if those other embodiments are not described or even mentioned in the present disclosure. Also, logical structural or functional changes may be made without departing from the scope of the present invention. While the disclosed subject matter will be described in conjunction with the enumerated claims, it will be understood that the exemplified subject matter is not intended to limit the claims to the disclosed subject matter. The following Detailed Description is, therefore, not to be taken in a limiting sense, and the scope of the present invention is defined by the appended claims and their equivalents.

References in the specification to "one embodiment", "an embodiment," "an example embodiment," "one example," "an example," etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 1 to about 5 millimeters (mm)" should be interpreted to include not only the explicitly recited range of about 1 mm to about 5 mm, but also each individual value within that range (e.g., 1.1 mm, 1.5 mm, 2 mm, 2.58 mm, 3 mm, 3.1245 mm, 4 mm, 4.00024 mm, 4.9965 mm, at so on) and sub-ranges within the recited range (e.g., 1.5 mm to 3 mm, 2 mm to 5 mm, 3.1 mm to 3.5 mm, and so on).

The term "about" as used herein can allow for a degree of variability in a value or range, for example, within 10%, within 5%, within 1%, within 0.5%, within 0.1%, within 0.05%, within 0.01%, within 0.005%, or within 0.001% of a stated value or of a stated limit of a range, and includes the exact stated value or range. The statement "about X to Y" has the same meaning as "about X to about Y," unless indicated otherwise. Likewise, the statement "about X, Y, or Z" has the same meaning as "about X, about Y, or about Z," unless indicated otherwise.

The term "substantially" as used herein refers to a majority of, or mostly, such as at least about 50%, 60%, 70%, 80%, 90%, 95%, 96%, 97%, 98%, 99%, 99.5%, 99.9%, 99.99%, or at least about 99.999% or more, or 100%.

In this document, the terms "a" or "an" are used, as is common in patent documents, to include one or more than one, independent of any other instances or usages of "at least one" or "one or more." The term "or" is used to refer to a nonexclusive "or," such that "A or B" includes "A but not B," "B but not A," and "A and B," unless otherwise indicated. The statement "at least one of" when referring to a listed group is used to mean one or any combination of two or more of the members of the group. For example, the statement "at least one of A, B, and C" can have the same meaning as "A; B; C; A and B; A and C; B and C; or A, B, and C," or the statement "at least one of D, E, F, and G" can have the same meaning as "D; E; F; G; D and E; D and F; D and G; E and F; E and G: F and G; D, E, and F; D, E, and G; D, F, and G; E, F, and G; or D, E, F, and G."

The terms "including" and "in which" are used as the plain-English equivalents of the respective terms "comprising" and "wherein." The terms "including" and "comprising" are open-ended—that is, a system, device, article, composition, formulation, or process can include elements in addition to those listed after such a term in the present disclosure or in the claims that follow the Detailed Description, and a system, device, article, composition, formulation, or process can include elements not listed and will still be deemed to fall within the scope of a claim, unless otherwise specified.

It is to be understood that the phraseology or terminology employed herein, and not otherwise defined, is for the purpose of description only and not of limitation. Any use of section headings is intended to aid reading of the document and is not to be interpreted as limiting, and information that is relevant to a section heading may occur within or outside of that particular section. All publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

In the methods described herein, the acts can be carried out in any order without departing from the principles of the disclosed method, except when a temporal or operational sequence is explicitly recited. Furthermore, specified acts can be carried out concurrently unless explicit language recites that they be carried out separately. For example, a recited act of doing X and a recited act of doing Y can be conducted simultaneously within a single operation, and the resulting process will fall within the literal scope of the process. Recitation in a claim to the effect that first a step is performed, then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first and steps B, C, D, and E can be carried out in any sequence between steps A and E, and that the sequence still falls within the literal scope of the claimed process. A given step or sub-set of steps may also be repeated.

Wrist-Worn Article

FIG. 1 shows a top view of an example wrist-worn article 10 that is configured to be strapped or otherwise secured to an arm of a wearer with an arcuate securing structure 12 that comprises one or more straps to secure the wrist-worn article 10 to another structure, such as to a wearer, for example to the wearer's arm (described in more detail below). Because the securing structure 12 is formed from one or more strap or band sections, it will also be referred to herein as a "strapping structure 12" or simply as a "strap 12." The wrist-worn article 10 can comprise one or any combination of one or more mechanical devices, one or more electronic devices, one or more electro-mechanical devices, or one or more ornamental articles designed to be worn by a wearer on his or her arm. In some examples, the wrist-worn article 10 and the strap 12 are designed and configured to be secured to the lower arm, also referred to as the forearm, of the wearer with the strap 12, such as to the portion of the forearm at or proximate to the wearer's wrist.

As described in more detail below, the concepts of the strap 12 described herein can be particularly beneficial for a wrist-worn article 10 that is designed so that at least one part of the article is worn tightly to, closely secured to, or snugly to the wearer's arm. In particular examples, the wrist-worn article 10 is a wrist-worn device that provides some functionality that may be desirable for the wearer. Examples of devices or articles that can be secured to a wearer's arm with a strap 12 to form the wrist-worn article 10 include, but are not limited to, one or any combination of:

a) a mechanical or electromechanical wristwatch, i.e., a wristwatch having a mechanical or electromechanical movement mechanism that drives the time-keeping functionality of the wristwatch including, but not limited to, those sold under the trades names ARMITRON, BALL, BLANCPAIN, BREITLING, BULOVA, BVLGARI, CARTIER, CITIZEN, FOSSIL, GRUEN, HAMILTON, LONGINES, MVMT, OMEGA, PATEK PHILIPPE, ROLEX, SKAGEN, TAG HEUER, TIMEX, VICTORINOX (also referred to as VICTORINOX SWISS ARMY or simply SWISS ARMY), or WENGER;

b) an electronic wristwatch including, i.e., a wristwatch including electronics configured to provide for time-keeping and optionally additional functionality, sometimes also referred to as a "digital" wristwatch, including, but not limited to, electronic wristwatches sold under the trade names CASIO, SEIKO or TIMEX;

c) a so-called "smartwatch," including, but not limited to, those sold by: Apple Inc., Cupertino, Calif., USA (i.e., those sold under the APPLE WATCH trade name); Samsung Electronics Co., Ltd., Yeongtong District, Suwon, South Korea (i.e., those sold under the SAMSUNG GEAR trade name); or Misfit Wearables Corp., Burlingame, Calif., USA (i.e., those sold under the MISFIT SHINE 2, MISFIT VAPOR, and MISFIT PHASE trade names);

d) fitness tracking devices, also referred to as "fitness trackers" or "step counters," including, but not limited to, the wrist-worn fitness trackers sold by: Fitbit, Inc., San Francisco, Calif., USA (e.g., those sold under the trade names FITBIT FLEX, FITBIT ALTA, FITBIT ALTA HR, FITBIT CHARGE, FITBIT CHARGE 2, FITBIT BLAZE, and FITBIT SURGE); Nokia Corp., Espoo, Finland (formerly Withings S. A., Issy-les-Moulineaux, France) (e.g., those sold under the NOKIA STEEL and NOKIA STEEL HR trade names (formerly WITHINGS ACTIVITE STEEL), or the NOKIA GO trade name (formerly the WITHINGS GO); Garmin International, Inc. (Olathe, Kans., USA) (i.e., those sold under the GARMIN VIVOACTIVE, GARMIN VIVOSMART, or GARMIN VIVOMOVE trade names); TomTom International BV, Amsterdam, The Netherlands (i.e., those sold under the TOMTOM TOUCH trade name); or Misfit Wearables Corp. (i.e., those sold under the MISFIT RAY, MISFIT SHINE, MISFIT FLARE, and MISFIT FLASH trade names);

e) position-determining or tracking devices, such as those referred to as "Global Positioning System," or "GPS," devices, including those that are used to track distance and route information for exercise, such as the many examples wrist-worn sport or fitness devices (e.g., running, biking, swimming, golf, etc.), or wrist-worn navigation devices, such as those sold by Garmin International, Inc. (e.g., those sold under the GARMIN FORERUNNER, GARMIN FENIX, GARMIN QUATIX, GARMIN APPROACH, GARMIN TACTIX, or GARMIN D2 trade names); TomTom International BV (e.g., those sold under the TOMTOM SPARK, TOMTOM RUNNER, TOMTOM ADVENTURER, and TOMTOM GOLFER trade names); Suunto, Vantaa, Finland (a subsidiary of Amer Sports Corp., Helsinki, Finland) (e.g., those sold under the SUUNTO SPARTAN, SUUNTO TRAVERSE, SUUNTO AMBITS, SUUNTO CORE, SUUNTO QUEST, SUUNTO M1, SUUNTO M2, and SUUNTO M5 trade names); or f) other wrist-worn articles, whether or not they can be considered a "device," i.e., may or may not have electronics or a mechanical or electromechanical mechanism to provide active functionality, which can include ornamental articles such as bracelets or other wrist-worn jewelry or adornments.

In the example shown in the figures, the wrist-worn article 10 is a wristwatch, such as a wristwatch 10 with a mechanical or electromechanical movement mechanism for keeping time for its wearer. For this reason, and for the sake of brevity, the wrist-worn articles described herein may be referred to simply as "wristwatch" or "watch," and the strapping structure that secures a wrist-worn article to a wearer's arm may be referred to as a "watch strap" or simply a "strap." For example, the wrist-worn article 10 of FIG. 1 will be referred to as "the wristwatch 10" or simply "the watch 10," and the strapping structure 12 will be referred to as "the watch strap 12" or simply "the strap." The specific design of the wrist-worn article 10 is depicted in the figures as a traditional analog-faced, mechanically-driven watch 10. However, those of skill in the art will appreciate that the concepts of the strap 12 described herein can be used to secure types of watches other than the traditional wristwatch 10 shown in FIG. 1 without departing from the scope of the present application, i.e., the strap 12 can be used to secure other watch types including, but not limited to, a digital-wristwatch type or a smart-watch type of wristwatch. Those of skill in the art will also appreciate that the concepts of the strap 12 described herein can also be used on wrist-worn articles other than wristwatches without departing from the scope of the present application, including, but not limited to: fitness-tracking devices; positional-determining devices, i.e., global-positioning system (GPS) devices; other wrist-worn electrical, mechanical, or electromechanical devices;

or non-device wrist-worn articles such as ornamental wrist-worn articles, including bracelets and other jewelry.

In the example shown in FIG. 1, the wrist-worn article 10 includes the strap 12, as mentioned above, and also includes a housing 14. For wrist-worn articles 10 that are devices, i.e., mechanical, electrical, or electromechanical devices such as the watch 10, the housing 14 can at least partially contain or enclose electronics, one or more mechanisms, or both, that provide for at least some of the functionality of the wrist-worn device 10. For example, the wristwatch device 10 of FIG. 1 can include a mechanical or electromechanical movement mechanism (not shown) that, in turn, drives an hour hand 16 and a minute hand 18 that indicate to the wearer the time, as is known with analog wristwatches such as the watch 10 shown in FIG. 1. In other examples, the housing 14 can enclose one or more electronic components that can electronically drive the hands 16, 18 or that can activate a display screen to show an image that mimics the hands 16, 18 or displays some other indication of time, such as a digital display for a digital wristwatch or a fitness tracking device.

In an example, the wrist-worn device 10 can also include one or more input structures that are mechanically or electrically connected to the electronics, one or more mechanisms, or both that are at least partially contained in the housing 14. In the example shown in FIG. 1, the watch 10 includes a crown 20 that is coupled to the electronics, one or more mechanisms, or both in the housing 14. In some examples, the crown 20 can allow the wearer to set the time that is being displayed by the watch 10, to reset the mechanical or electromechanical movement mechanism of the watch 10 (also referred to as "winding" the movement mechanism), or to interact with the electronics or mechanism in some other way. Other input structures or devices can include, but are not limited to, one or more buttons on the housing that interact with the device electronics or mechanism, one or more switches, or a microphone that allows for audio-initiated interaction with the electronics or mechanism (such as through the SIRI personal assistant functionality on an APPLE WATCH smart watch or similar functionality on other electronic smart devices).

Strap

The strapping structure 12, also referred to herein as the strap 12, includes one or more strap sections 22 that cooperate to form the strap 12. Traditionally, a strap for a wristwatch, such as the wristwatch 10 shown in FIG. 1, is formed by a pair (i.e., two corresponding) of strap sections 22A and 22B that fit together or otherwise interact in a cooperative manner to form what is, functionally, a single strap 12 to secure the wrist-worn article 10 to a wearer's arm. However, those of skill in the art will appreciate that the strap 12 need not comprise a pair of strap sections 22A, 22B that cooperate to form a single strap 12, but rather could comprise a single strap section 22 that, by itself forms the strap 12, or it could comprise more than two strap sections 22 that cooperate to form a single strap 12 or that cooperate to form two or more straps 12 for securing the wrist-worn article 10 to the wearer.

In an example, the strap 12 shown in FIG. 1 includes the traditional combination of a pair of strap sections 22A, 22B that are each separately coupled to the housing 14. In an example, each strap section 22 includes a first end 24 that can be coupled to a corresponding mounting location 28 on the housing 14, also referred to as the proximal end 24, and a second free end 26 opposite the proximal end 24, also referred to as the distal end 26. In the example shown in FIG. 1, the strap 12 includes a first strap section 22A with a proximal end 24A that is coupleable to a first position of the housing 14 at a first mounting location 28A and a second strap section 22B with a proximal end 24B that is coupleable to a second position of the housing 14 at a second mounting location 28B. In an example, the first mounting location 28A and the second mounting location 28B are on generally opposite sides of the housing 14 along a housing axis $A_H$. In an example, the housing axis $A_H$ is an imaginary line that runs through a center point of the housing 14 and is generally parallel to a central plane of the housing 14. In some examples, the housing 14 is itself planar or substantially planar in shape or has at least one major outer surface that is planar or substantially planar, as is common with wristwatches and with many other wrist-worn devices, and the housing axis $A_H$ is generally parallel to the planar or substantially planar housing 14 or of the planar or substantially planar major outer surface on the housing 14.

In the example shown in FIG. 1, the first mounting location 28A is generally located at an intersection of the housing axis $A_H$ and a side wall 30 of the housing 14 on a first side of the housing 14 (i.e., the portion of the side wall 30 on the top side of the housing 14 from the perspective shown in FIG. 1), and the second mounting location 28B is generally located at an intersection of the housing axis $A_H$ and the side wall 30 on a second side of the housing 14. In an example, the second side is opposite to the first side (i.e., at the portion of the side wall 30 on the bottom side of the housing 14 from the perspective shown in FIG. 1). In an example, each of the one or more side walls 30 that the strap 12 is coupled to are perpendicular or substantially perpendicular to a planar or substantially planar major outer surface of the housing 14, such as a front surface 32 of the housing 14 (also referred to as the front face 32). In the example of FIG. 1, the front face 32 is the face that the wearer looks at to ascertain information that the wrist-worn device 10 is displaying to the wearer, such as the time for a wristwatch 10, fitness information for a fitness-tracking device, or positional, distance, or route information for a GPS device.

At least a portion of the strap 12 is configured to provide a contoured inner surface (e.g., the inner surface 50 that is in contact with the wearer's arm 2) that corresponds to the natural shape of the outer surface 4 of the wearer's arm 2. As noted above, the outer surface 4 of a human arm 2 tends to be generally frustoconical in shape. Therefore, in an example, at least a portion of the strap 12 is configured so that the inner surface 50 forms a generally frustoconical contour, such as a frustoconical or substantially frustoconical contour, that corresponds to the generally frustoconical portion of the outer surface 4 of the wearer's arm 2 when the strap 12 is coupled to the housing 14 and when the strap 12 is strapped to the wearer's arm 2. For example, as shown in FIG. 4, the portion of the arm 2 on which the wrist-worn article 10 is worn can be generally frustoconical in shape such that the outer surface 4 forms an angle θ relative to an axis of the arm 2, labeled as $A_{Arm}$ in FIG. 4. To accommodate the contour of the outer surface 4, in an example, the strap 12 is configured so that when it is worn on the arm 2 the inner surface 50 is angled relative to the arm axis $A_{Arm}$ by an angle φ that is substantially equal to the angle θ for at least a portion of the outer surface 4 around the circumference of the arm 2. In some examples, it has been found that for the human arm, good fit can be achieved for most people with an inner surface 50 having an angle φ (when worn) that is from about 1° to about 20°, such as from about 2° to about 10°, for example from about 3° to about 5°, such as about 4°. In other examples, a strap (such as the strap 12 of FIG. 1, the strap 60 of FIG. 3, or the strap 80 of FIG. 6, or a strap that includes any combination of the features described herein with respect to the straps 10, 60, and 80) can be configured to form a strap inner surface with a frustoconical or substantially frustoconical inner surface that forms an angle relative to the axis of the arm $A_{Arm}$ on which the strap is worn (e.g., the angle φ that is one or more of: 1°, 1.1°, 1.2°, 1.3°, 1.4°, 1.5°, 1.6°, 1.7°, 1.8°, 1.9°, 2°, 2.1°, 2.2°, 2.3°, 2.4°, 2.5°, 2.6°, 2.7°, 2.8°, 2.9°, 3°, 3.1°, 3.2°, 3.3°, 3.4°, 3.5°, 3.6°, 3.7°, 3.8°, 3.9°, 4°, 4.1°, 4.2°, 4.3°, 4.4°, 4.5°, 4.6°, 4.7°, 4.8°, 4.9°, 5°, 5.1°, 5.2°, 5.3°, 5.4°, 5.5°, 5.6°, 5.7°, 5.8°, 5.9°, 6°, 6.1°, 6.2°, 6.3°, 6.4°, 6.5°, 6.6°, 6.7°, 6.8°, 6.9°, 7°, 7.1°, 7.2°, 7.3°, 7.4°, 7.5°, 7.6°, 7.7°, 7.8°, 7.9°, 8°, 8.1°, 8.2°, 8.3°, 8.4°, 8.5°, 8.6°, 8.7°, 8.8°, 8.9°, 9°, 9.1°, 9.2°, 9.3°, 9.4 9.5°, 9.6°, 9.7°, 9.8°, 9.9°, 10°, 10.1°, 10.2°, 10.3°, 10.4°, 10.5°, 10.6°, 10.7°, 10.8°, 10.9°, 11°, 11.1°, 11.2°, 11.3°, 11.4°, 11.5°, 11.6°, 11.7°, 11.8°, 11.9°, 12°, 12.1°, 12.2°, 12.3°, 12.4°, 12.5°, 12.6°, 12.7°, 12.8°, 12.9°, 13°, 13.1°, 13.2°, 13.3°, 13.4°, 13.5°, 13.6°, 13.7°, 13.8°, 13.9°, 14°, 14.1°, 14.2°, 14.3°, 14.4°, 14.5°, 14.6°, 14.7°, 14.8°, 14.9°, 15°, 15.1°, 15.2°, 15.3°, 15.4°, 15.5°, 15.6°, 15.7°, 15.8°, 16°, 16.1°, 16.2°, 16.3°, 16.4°, 16.5°, 16.6°, 16.7°, 16.8°, 16.9°, 17°, 17.1°, 17.2°, 17.3°, 17.4°, 17.5°, 17.6°, 17.7°, 17.8°, 17.9°, 18°, 18.1°, 18.2°, 18.3°, 18.4°, 18.5°, 18.6°, 18.7°, 18.8°, 18.9°, 19°, 19.1°, 19.2°, 19.3°, 19.4°, 19.5°, 19.6°, 19.7°, 19.8°, 19.9°, or 20°, or any range including endpoints of this list (i.e., from about 2.2° to about 10.4°, from about 3.5° to about 4.5°, from about 3.9° to about 15.6°, from about 3.7° to about 4.3°, from about 3.9° to about 4.1°, from about 6° to about 14°, and so on, to name just a few ranges).

In an example, a configuration of the strap 12 that provides for the generally frustoconical contour (e.g., a frustoconical or substantially frustoconical contour) of the inner surface 50 includes the strap 12 having at least one portion 40 of its length L that is arcuate in shape relative to the housing axis $A_H$, where the length L is defined as the length of the strap 12 when laid flat or substantially flat as in FIG. 1. In examples where the strap 12 comprises two or more strap sections 22A, 22B, each strap section 22A, 22B can include at least one corresponding portion 40 of its length (when laid flat) that is arcuate relative to the housing axis $A_H$. In an example, a portion 40A of the flat length $L_A$ of the first strap section 22A and a portion 40B of the flat length $L_B$ of the second strap section 22B are arcuate.

As used herein when referring to the strap 12 or the strap sections 22A, 22B, the terms "arcuate," "curved," or similar terms, refer to at least a portion of the length L of the strap 12 or the length $L_A$, $L_B$ of a strap section 22A, 22B being non-straight in a lateral direction $D_{Lat}$ away from the housing axis $A_H$, at least when the strap 12 is laid flat as shown in FIG. 1, i.e., so that at least a portion of the length of the strap 12 or strap sections 22A, 22B forms an arc shape or a curve.

Figure 2:
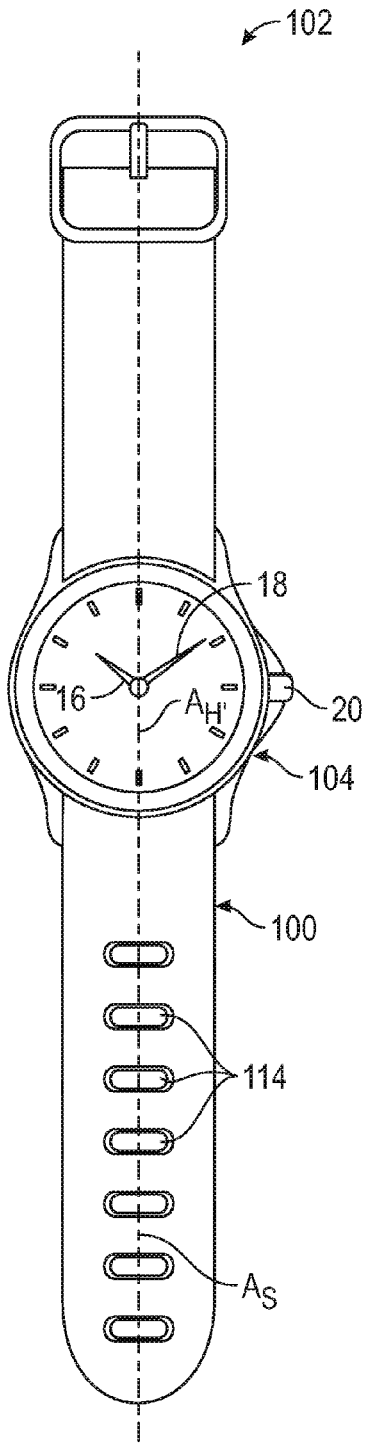
FIG. 2 is a top plan view of an example wristwatch with a conventional straight strap.

As described in more detail below, the one or more arcuate portions 40A, 40B are provided and configured so that the strap 12 will form an inner surface that corresponds to at least a portion of the general frustoconical outer surface 4 of the wearer's arm 2 to provide for a more comfortable fit of the wrist-worn article 10 on the wearer's arm 2. The one or more arcuate portions 40A, 40B of the wrist-worn article 10 of the present disclosure is in contrast to a conventional watch strap that is straight, such as the example straight strap 100 for a conventional wristwatch 102, shown in FIG. 2. As can be seen in FIG. 2, the conventional straight strap 100 extends substantially parallel to and is aligned with an axis $A_H'$ of a housing 104 of the conventional wristwatch 102. For the sake of brevity each portion 40 of the strap 12 that is arcuate relative to the housing axis $A_H$ will be referred to as the "arcuate portion 40."

In some examples, when laid flat, all or substantially all of the length L of the strap 12, or the lengths $L_A$, $L_B$ of each strap section 22A, 22B that forms the strap 12, is arcuate relative to the housing axis $A_H$. In other words, in such an example, a length $L_{Arc}$ of the arcuate portion 40 for each strap section 22 is substantially equal to the length $L_A$, $L_B$ of that strap section 22A, 22B such that the strap section 22A, 22B is formed completely or substantially completely by its corresponding arcuate portion 40A, 40B. Put another way, each arcuate portion 40A, 40B and its corresponding strap section 22A, 22B are one and the same.

In an example, the curve of each arcuate portion 40A, 40B is defined by the corresponding curve of an imaginary line that runs through the lateral center points along the length $L_A$, $L_B$ of the strap section 22A, 22B, which will be referred to as the "curved axis $A_C$" for brevity. As can be seen in FIG. 1, when the strap 12 is laid flat, the curved axis $A_C$ of the strap 12 gets further and further away from the housing axis $A_H$, in the lateral direction $D_{Lat}$, as each strap section 22A, 22B extends from its proximal end 24A, 24B toward its distal end 26A, 26B. This is in contrast to the conventional straight strap 100 for the conventional wristwatch 102 shown in FIG. 2, where a central strap axis $A_S$ is parallel to and substantially conforming with the housing axis $A_H'$ of the housing 104 of the conventional wristwatch 102.

In an example, the entire or substantially the entire length $L_A$ of the first strap section 22A is made up of an arcuate portion 40A, the entire or substantially the entire length $L_B$ of the second strap section 22B is made up of an arcuate portion 40B, or both. In some examples, a small portion of each strap section 22A, 22B is still substantially straight relative to the housing axis $A_H$, e.g., that is substantially aligned with the housing axis $A_H$, in order to form part of a connective link 42A, 42B to the housing 14. A non-limiting example of the structures that can provide the connective link 42A, 42B includes a spring bar 43A, 43B that that engages a structure at the proximal end 24A, 24B of a corresponding strap section 22A, 22B (such as with each spring bar 43A, 43B being inserted through a loop at the proximal end 24A, 24B) and that also engages a structure on the housing 14, such as a set of lugs 44A, 44B with slots, grooves, or other openings that the spring bar 43A, 43B can engage.

In the example wrist-worn article 10 shown in FIG. 1, the lugs 44A, 44B and the portion of the strap sections 22A, 22B at the proximal ends 24A, 22B that connect to the lugs 44A, 44B are generally or substantially parallel with the housing axis $A_H$ and the spring bars 43A, 43B that connect the strap sections 22A, 22B to the lugs 44A, 44B are generally or substantially perpendicular to the housing axis $A_H$. The example lugs 44A, 44B are substantially similar or even identical to lugs 106 on the housing 104 of the conventional wristwatch 102 shown in FIG. 2, i.e., to lugs 106 configured for the conventional straight strap 100. In this way, the example strap 12 with its example strap sections 22A, 22B shown in FIG. 1 could be a strap 12 that has been designed as an accessory for an existing wrist-worn housing 14, for example a third-party accessory made and sold by a supplier other than the original manufacturer of the wrist-worn housing 14, similar to those sold by Hadley-Roma, Largo, Fla., USA.

Figure 3:
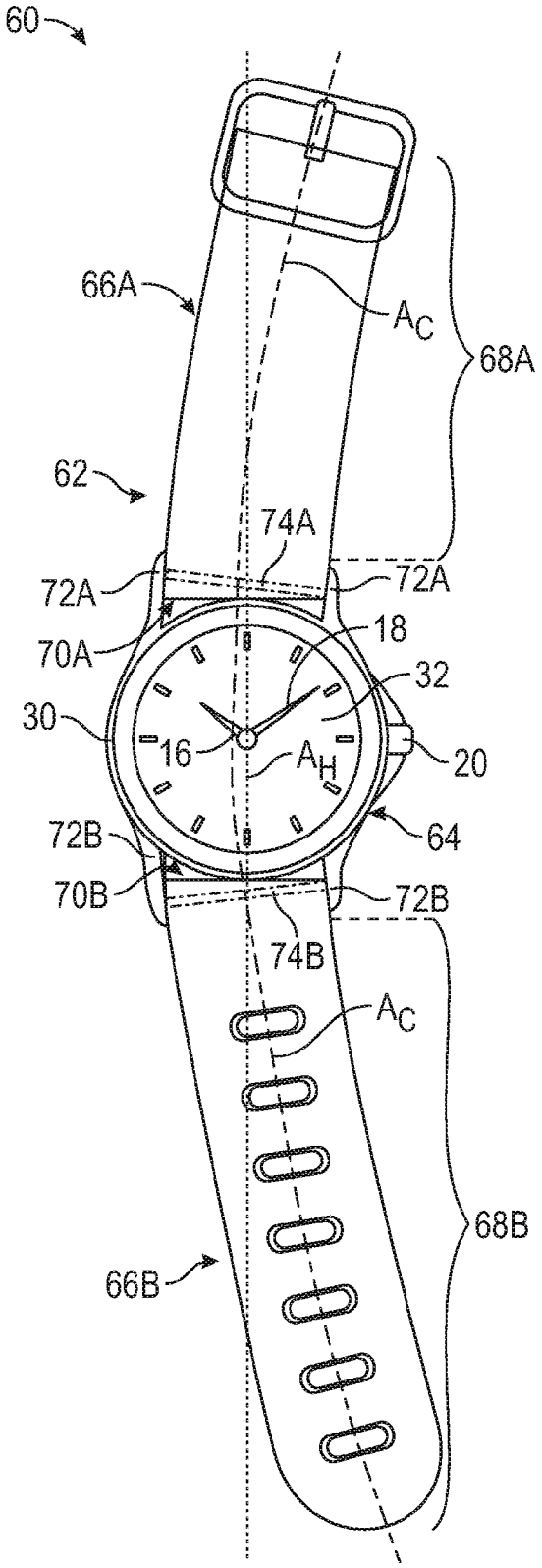
FIG. 3 is a top plane view of an arcuate strap that is similar or identical to the arcuate strap shown in FIG. 1 connected to another example housing for a wrist-worn article.
Figure 4:
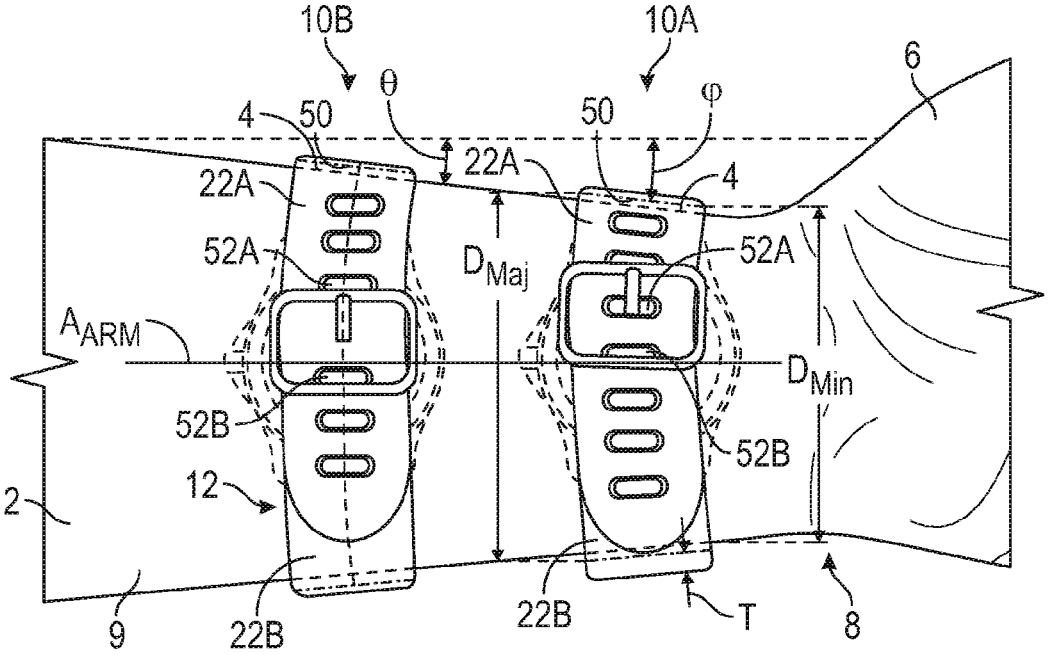
FIG. 4 is a conceptual bottom plan view of two of the example wrist-articles having an arcuate strap shown in FIG. 1 being worn at two different locations along a wearer's arm.

FIG. 3 shows another example of a wrist-worn article 60, such as a wristwatch 60, that is designed and manufactured with a housing 64 that accommodates a strap 62 having one or more arcuate portions, as compared to the example wrist-worn article housing 14 that may be configured for a conventional straight strap and onto which an arcuate strap 12 can be fitted. Like the strap 12 described above, the example strap 62 shown in FIG. 3 includes a pair of strap sections 66A, 66B each including an arcuate portion 68A, 68B. As can be seen in FIG. 3, the curve of the arcuate portions 68A, 68B causes the proximal ends 70A, 70B of the strap sections 66A, 66B to be oriented at an angle relative to the housing axis $A_H$ (rather than the strap 12 shown in FIG. 1, where the strap sections 22A, 22B include a portion at their proximate ends 24A, 24B that have been oriented to be parallel or substantially parallel to the housing axis AO. In order to accommodate the angled proximal ends 70A, 70B, the housing 64 of the wrist-worn article 60 includes lugs 72A, 72B (or any other connection link structure) that are also angled away from the housing axis $A_H$ by approximately the same angle as the proximal ends 70A, 70B. In an example, the spring bars 74A, 74B that engage with the angled lugs 72A, 72B to couple the strap sections to the housing 64 are also angled compared to the corresponding angle of the spring bars 43A, 43B on the wrist-worn article 10 in FIG. 1 (which is generally or substantially perpendicular to the housing axis AO. Returning to FIG. 1, in an example, when the strap 12 is laid flat, a first curved edge 46 of the arcuate portion 40 forms a concavely-curved edge 46 of the strap 12 and a second edge 48 of the arcuate portion 40 forms a convexly-curved edge 48 that opposes the concavely-curved first edge 46. Similarly, in the example with a pair of strap sections 22A, 22B, the arcuate portion 40A and 40B of each strap section 22A and 22B can include a concavely-curved first edge 46A and 46B and an opposing convexly-curved second edge 48A and 48B, when the strap sections 22A, 22B are laid flat. In some examples, when the strap 12 is laid flat, one or both of the first edge 46 and the second edge 48 of each arcuate portion 40 are concentric with the curved axis $A_C$, i.e., with the distance between each edge 46, 48 and the curved axis $A_C$ being constant or substantially constant throughout the entire length of the arcuate portion 40 and with the distance between the curved axis $A_C$ and each edge 46, 48 being equal to about one half of the width W of the strap 12. However, concentricity between the edges 46, 48 and the curved axis $A_C$ or between the first edge 46 and the second edge 48 is not required.

As described above, the strap 12 can be configured so that the inner surface 50 has an inner contour that corresponds to the outer contour of the outer arm surface 4, such as by forming an angle φ having any one of the values or range of values described above. In an example, this configuration is achieved with each arcuate portion 40 having a radius of curvature at the curved axis $A_C$ that is from about 20 centimeters (cm) to about 100 centimeters at its maximum radius of curvature (i.e., at the point along the length of the arcuate portion 40 that has the most gentle or least severe curve away from the housing axis $A_H$ in the lateral direction $D_{Lat}$), such as from about 40 cm to about 60 cm, for example about 55 cm. In some examples, the radius of curvature along the entire length $L_{Arc}$ of the arcuate portion 40 is constant or substantially constant, with variation in the radius of curvature of no more than about 10% to 25% from the average radius of curvature. Those of skill in the art will appreciate, however, that the specific radius of curvature values used for a particular strap 12 may depend on the particular wearer arm geometry or range of geometries that the strap 12 is being designed for, as described in more detail below. As such specific radius of curvature values are not to be considered limiting to the subject matter of the present application.

The one or more arcuate portions 40A, 40B of the strap 12 are configured depending on which arm 2 the wearer intends to wear the wrist-worn article 10, i.e., on the right arm or the left arm. The arcuate portions 40A, 40B in the example shown in FIG. 1 are configured to be worn on the left arm 2 of a human wearer, i.e., as is typical and customary for right-handed people. FIG. 4 shows examples of wrist-worn articles 10A, 10B with this configuration of arcuate portions 40A, 40B after being strapped onto the wearer's arm 2. However, as will be appreciated by those of skill in the art, the strap 12 and the wrist-worn article 10 can be configured to be worn on a wearer's right arm (i.e., as is typical and customary for left-handed people) by simply configuring the strap 12 as a mirror image of that which is shown in FIGS. 1 and 4, i.e., by flipping the strap 12 about the housing axis $A_H$. In such an example, this configuration would include the curved axis $A_C$ of the strap 12 curving in the opposite direction away from the housing axis $A_H$ (i.e., toward the left when the strap 12 is laid flat rather than to the right as shown in FIG. 1). In an example, the curved edges 46 and 48 would also curve in the opposite direction from what is shown if the strap 12 is configured to be worn on the right arm 2.

Contour Fit of the Strap

Turning to FIG. 4, a strap 12 configured to provide a generally frustoconical inner surface 50 when the strap 12 is moved into a securing or wrapped position, i.e., when the strap 12 is wrapped around the arm 2 of a wearer as shown in FIG. 4, can provide for a better and more comfortable fit for the wearer. As described above, in an example, the portion 40A, 40B of the strap 12 that is arcuate provides an inner surface 50 of the final strap 12 that is generally or substantially frustoconical when the strap 12 is placed in the wrapped position. The generally frustoconical shape of the inner surface 50 corresponds to the general geometry of an outer surface 4 of the wearer's arm 2, which is also generally or substantially frustoconical in shape for at least a portion of the arm 2. In some examples, when the strap 12 is in the wrapped position, the generally or substantially frustoconical inner surface 50 substantially matches, within a specified tolerance, a portion of the outer surface 4 of the arm 2.

As used herein, the term "frustoconical" when referring to a surface, such as the inner surface 50 of strap 12 or the outer surface 4 of the arm 2, refers to the geometrical section formed by the frustum of a geometrical cone, i.e., a cone where at least a portion of the cone's apex has been truncated, or where portions of the apex and the base of the cone have been truncated. Truncation of a cone to form a frustoconical surface is often via truncating planes that are normal or substantially normal to the central axis of the cone, but this is not required by the subject matter of the present disclosure. Nor is planar truncation a requirement, as a surface geometry with non-planar edges can still be considered "frustoconical" so long as the surface in question generally has the shape of a section of a cone that has been truncated into a frustum.

The formation of a generally frustoconical inner surface 50 due to the curve of the one or more arcuate portions 40A, 40B of the strap 12 allows a wrist-worn article 10 as described herein to provide a fit for the strap 12 that generally conforms, and in some examples closely conforms, to the outer surface 4 of the wearer's arm 2. This is best illustrated in FIG. 4, where it can be seen that the generally frustoconical contour shape of the inner surface 50 of the strap 12 substantially conforms to the generally frustoconical contour shape of the outer surface 4 of the wearer's arm 2. The close matching of the contour shape of the inner surface 50 to that of the arm's outer surface 4 allows the strap 12 to be worn relatively tight with reduced or eliminated likelihood of the watch strap 12 pinching the wearer's arm 2.

In particular, this closer and contoured fit can provide a more comfortable fit when compared to a conventional wristwatch 102 that uses a straight strap 100. Two examples of conventional wristwatches 102A, 102B are shown in a worn and secured position on a wearer's arm 2 in FIG. 5. When the conventional straight strap 100 is wrapped around a wearer's arm 2, the straight strap 100 forms a cylindrical or substantially cylindrical inner surface 110 rather than the generally frustoconical or substantially frustoconical inner surface 50 on the strap 12. The placement of the cylindrical contour shape of the inner surface 110 of the conventional strap 100 onto the generally frustoconically shaped arm 2 of the wearer results in uneven pressure distribution or pinch points 112 (shown with the second wristwatch 102B in FIG. 5), or both, on the wearer's arm 2. The uneven pressure distribution can be particularly noticeable at thicker or wider parts of the wearer's arm 2, i.e., on the side the strap 100 that is opposite to the wearer's hand 6. This is shown conceptually in FIG. 5, where the constant or substantially constant radius of the inner surface 110 due to its cylindrical contour shape causes the inner surface 110 to contact and pinch the outer surface 4 of the wearer's arm 2 to create the pinch points 112 on the wearer's arm 2. This uneven pressure distribution and pinching can occur even with strap materials that are flexible or malleable, such as cloth, leather, plastic, rubber, or silicone straps, but it can be particularly problematic with less forgiving materials such as metal straps or bands. Discomfort from the conventional straight strap 100 can also be particular pronounced with fitness devices that are worn tightly in order to be most effective. For example, a wearer may wish to wear a running or other exercise watch particularly tightly to prevent the watch from slipping due to sweating. Similarly, devices that use an optical heart rate monitor to measure the wearer's heart rate for calorie calculation or determine exercise intensity must also be worn tightly for the optical sensor to get an accurate reading. In short, for devices like these that require tightness for optimum functionality, the pinching or other discomfort from a conventional straight strap 100 is not only undesirable, but also is unavoidable.

The potential pinching due to the imperfect fit between the generally cylindrical inner surface 110 of the conventional strap 100 and the generally frustoconical contour of the outer surface 4 of the wearer's arm 2 has led many wearer's to set the tightness of the conventional straight strap 100 at a looser setting in order to avoid this pinching. This is shown conceptually in FIG. 5 with a first wristwatch 102A (i.e., the left-most wristwatch 102A in FIG. 5), which is set on a notch 114A that is looser than the notch 114B that is more optimal for the position of the wristwatch 102A along the wearer's arm 2. This looser setting has avoided the formation of pinch points, such as the pinch points 112 formed by a second wristwatch 102B (i.e., the right-most wristwatch 102B in FIG. 5), which is set at a more optimal tightness notch 114C for snug securement of the second wristwatch 102B at its position on the wearer's forearm 9. But the avoidance of pinch points in the first wristwatch 102A has come at the cost of a looser-than-optimal tightness setting, as can be seen by the larger gap G between the cylindrical inner surface 110 of the conventional strap 100 and the frustoconical outer surface 4 of the wearer's arm 2 that resulted from using the looser notch 114A for the first wristwatch 102A. This looser tightness setting and the resulting gap G, in turn, allows the first wristwatch 102A to more freely slide at least partially up and down the wearer's arm 2 and/or bounce on the wearer's arm 2, which can be uncomfortable and annoying for the wearer. In other words, the cylindrical inner surface 110 of the conventional strap 100 that results from the conventional straight strap 100 forces wearers to make a Hobson's choice between either: (a) avoiding or minimizing pinching for relatively acceptable comfort of the wrist-worn article, i.e., as was chosen the first wristwatch 102A in FIG. 5, but with the undesirable and often annoying problem of the wrist-worn article sliding along the arm 2 and bouncing against the arm 2 during use; or (b) provides for a fit that avoids sliding or bouncing of the wrist-worn article, i.e., as was chosen for the second wristwatch 102B, but with the caveat that the strap 100 or the wristwatch housing 104, or both, uncomfortably or even painfully pinch the wearer's arm 2. For some strap materials and geometries, the choice between these two desirable outcomes, i.e., comfort or proper fit, can be mutually exclusive or very nearly so.

The strap 12 that provides for the generally frustoconical inner surface 50 can minimize or avoid this undesirable choice because, as shown in FIG. 4, the inner surface 50 of the strap 12 has a contour that generally or substantially matches the generally frustoconical contour of the outer surface 4 of the wearer's arm 2. The matching or substantially matching contours of the inner surface 50 of the strap 12 and the outer surface 4 of the arm 2 allows the wearer to set the strap 12 at a tightness setting that will hold the wrist-worn article 10 snugly against the wearer's arm 2, which minimizes or prevents the wrist-worn article 10 from sliding along the wearer's arm 2. Moreover, the strap 12 does so in a way that avoids or prevents uneven pressure distribution across the width W of the strap 12, which in turn avoids or prevents the formation of pinch points into the wearer's arm 2 by the strap 12.

In addition, the geometry of the strap 12 that provides for the frustoconical contour of the inner surface 50 of the strap 12, i.e., the geometry of the one or more arcuate portions 40A, 40B of the strap sections 22A, 22B, can be selected so that the generally frustoconical contour of the inner surface 50 is able to correspond to, and in some examples match or substantially match, the generally frustoconical contour of the outer surface 4 of the wearer's arm 2 at more than one position along the wearer's arm 2. For example, the geometry of the one or more arcuate portions 40A, 40B can be configured so that if the wearer chooses to wear the wrist-worn article 10 proximate to the hand 6, i.e., at or near the wrist 8 as with a first wrist-worn article 10A (i.e., the left-most wrist-worn article 10A in FIG. 4), and the strap 12 is set at an appropriate tightness setting (i.e., at a first notch 52A), the frustoconical contour of the inner surface 50 of the strap 12 will correspond to (i.e., match or substantially match) the contour of the outer surface 4 at the wrist 8. The same geometry of the one or more arcuate portions 40A, 40B can also be configured so that if the wearer chooses to wear the wrist-worn article 10 further up the arm 2 where the arm 2 is thicker, such as on the forearm 9, as with a second wrist-worn article 10B (i.e., the right-most wrist-worn article 10B in FIG. 4), and at the appropriate tightness setting (i.e., at a second notch 52B), then the resulting frustoconical contour of the inner surface 50 will correspond to (i.e., match or substantially match) the contour of the outer surface 4 at the forearm 9. In this way, the strap 12 of the present disclosure can provide for more flexibility for the wearer to choose where and how to wear the wrist-worn article 10 without having to sacrifice fit or comfort.

Method of Fitting a Strap

The concept of the one or more arcuate portions 40A, 40B forming the generally frustoconical inner surface 50 of the strap 12 can be used as part of a method of fitting a strap 12 to a particular intended wearer of the wrist-worn article 10. As will be appreciated by those of skill in the art, different people can have a wide variety of arm geometries that can result in a wide variety of contour shapes for the outer surfaces 4 of wearers' arms 2. For example, two people might have exactly the same cross-sectional shape and circumference at their wrist 8, but one of the people might have a skinny or non-muscular forearm 9 resulting in a contour shape of the outer surface 4 that is much closer to a true cylinder, although it is still generally frustoconical in shape. In contrast, the other person might have a higher body-fat composition or be more muscular than the first person, resulting in a more pronounced conical angle for the frustoconical contour of the outer surface 4. In such a scenario, the example of the strap 12 and resulting inner surface 50 might be ideal for the first person, but might still pinch the second person because the angle of the inner surface 50 might still be too close to the cylindrical inner surface 110 of the conventional strap 100. Or alternatively, the resulting inner surface 50 of the example strap 12 shown in FIG. 4 might be well suited for the second person's more pronounced frustoconical arm 2, but the strap 12 might end up feeling slightly off balance to the first person having an arm 2 that is closer to being cylindrical.

The present disclosure, therefore, also includes a method of fitting a strapping structure, such as the strap 12, for a particular user (i.e., a specific wearer) to provide a wrist-worn article 10 that matches or substantially matches the particular contour of the outer surface 4 of that wearer's arm 2. In an example, the method includes the following steps:

(a) determining one or more physical parameters of the wearer's arm 2, i.e., of a specified portion of the outer surface 4 of the arm 2;

(b) selecting one or more geometrical curvature parameters for a strap 12, when the strap 12 is laid flat, that correspond to the one or more determined physical parameters of the wearer's arm 2, such as one or more arcuate portions 40 with one or more specified curvature parameters for each of one or more strap sections 22 of a watch strap 12;

(c) making or receiving the strap 12 having the one or more selected geometrical curvature parameters; and optionally (c) coupling the strap 12 to a housing 14 of the wrist-worn article 10.

The step of determining the one or more physical parameters of the wearer's arm 2 can include determining one or more specified parameters of the outer surface 4 of the wearer's arm 2, such as by determining one or more specified parameters of the contour shape of the outer surface 4. As used herein, the terms "physical parameter" "specified physical parameter," or "specified parameter" in reference to the wearer's arm 2 refers to one or more measurable geometry-based characteristics of the wearer's arm 2 that can be measured and used to describe or define the geometric or contour shape of at least a portion of the wearer's arm 2, and in particular to describe or define the geometric shape or contour of at least a portion of the outer surface 4 of the wearer's arm 2. In an example, determining the one or more physical parameters of the wearer's arm 2 includes measuring one or more specified portions of the arm 2, i.e., by measuring specific distances, sizes, or other geometries in much the same way that a tailor measures a customer for a custom-fitted suit or other custom-fitted clothing.

Figure 5:
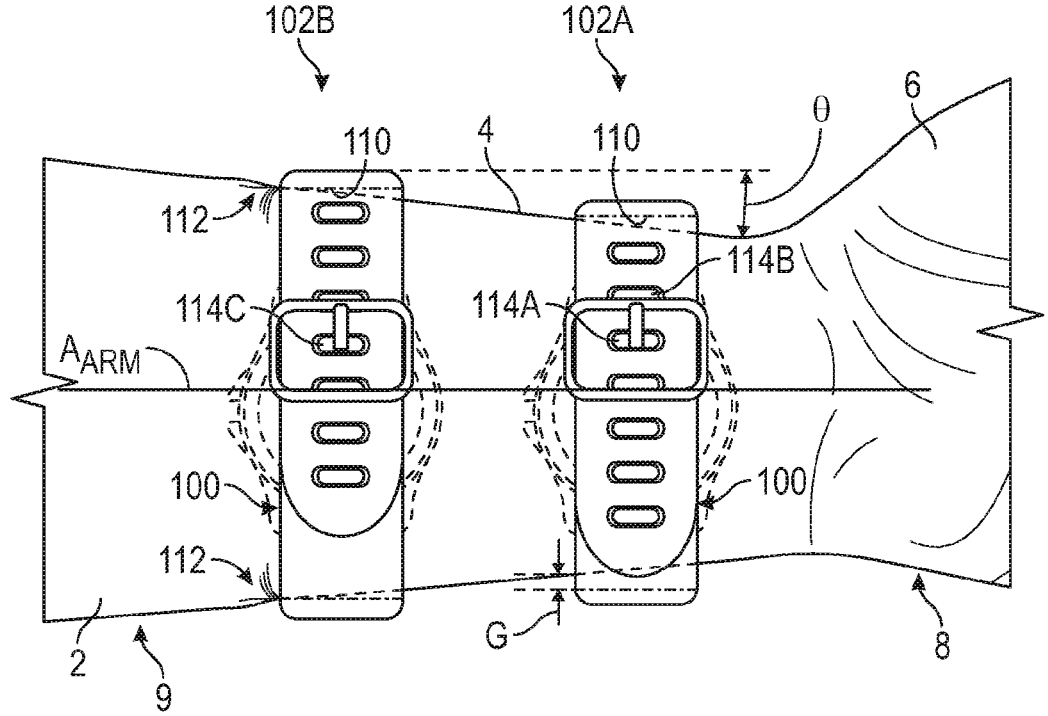
FIG. 5 is a conceptual bottom plan view of two of the example wristwatch with the straight strap shown in FIG. 2, with each wristwatch being worn at a different location along a wearer's arm.

In some examples, the one or more specified physical parameters include a measure of the thickness or girth of the wearer's arm 2 at one or more specified positions along the arm 2. Several specific measurements could be used to define thickness or girth, including but not limited to: arm diameter at a specified location; arm radius at a specified location; the dorsal-to-ventral thickness (i.e., thickness from a top surface, or dorsal surface, to a bottom surface, or ventral surface) at a particular location; the medial to lateral thickness (i.e., thickness from the inside side closest to the torso to the outside side of the arm) at a particular location; and a circumference, i.e., the distance around the outer surface 4 of the arm 2, whether the cross-sectional shape of the arm 2 at that particular location is circular or not. In some examples, the one or more specified physical parameters include an angle formed between the outer surface 4 of the arm 2 and the axial direction of the arm (also referred to as the "arm axis" and designed $A_{Arm}$ in FIGS. 4 and 5), such as the angle θ shown in FIGS. 4 and 5. The specific angle θ that is shown in FIGS. 4 and 5 is the lateral angle θ of the outer surface 4 relative to the arm axis $A_{Arm}$, i.e., the angle θ in a lateral direction from the lateral or medial side of the arm 2 (i.e., left or right sides) as opposed to from the dorsal or ventral sides (i.e., the top or bottom sides). It will be appreciated that the specified physical parameters can include an angle of the outer surface 4 in the dorsal or ventral directions, i.e., a dorsal or ventral angle (not shown), in addition to or in place of the lateral angle θ shown in FIGS. 4 and 5.

In an example, the step of making or selecting a strap 12 includes selecting one or more specified parameters for the geometry of the strap 12, referred to hereinafter as a "geometrical parameters of the strap 12," or "strap geometrical parameters," or simply "strap parameters." In some examples, the one or more strap parameters are selected to correspond to the specified physical parameters of the wearer's arm 2 that were measured in the previous step to provide for a good fit for the strap 12 to the arm 2. In particular, in some examples, the one or more strap parameters that are selected relate to a particular geometry of the one or more arcuate portions 40 that will, in turn, result in the inner surface 50 of the strap 12 having a contour shape that corresponds to a contour shape of the outer surface 4 of the wearer's arm 2, referred to hereinafter generally as "geometrical curvature parameters of the strap 12," "strap geometrical curvature parameters," or simply "strap curvature parameters" or "curvature parameters." In an example, selecting the one or more strap parameters includes selecting one or more specified curvature parameters for each of the one or more arcuate portions 40A, 40B so that the resulting inner surface 50 of the strap 12 corresponds to the contour of the outer surface 4 of the arm 2 at the location where the specified physical parameters were determined when the strap 12 is wrapped around the wearer's arm 2. The curvature parameters that are selected for the arcuate portion 40A of the first strap section 22A can be the same or different from those selected for the arcuate portion 40B of the second strap section 22B. In some examples, the specified curvature parameters can include, but are not limited to: a radius of curvature of the curved axis $A_C$; a radius of curvature for the concave edge 46 of the strap 12; a radius of curvature of for the convex edge 48; or a width W of the strap 12.

As will be appreciated, the overall radius of curvature of the curved axis $A_C$ of the strap 12 generally corresponds to an angle φ that the inner surface 50 makes relative to the arm axis $A_{Arm}$. In an example, a smaller radius of curvature for the curved axis $A_C$ (i.e., the arcuate portion 40 curving away from the housing axis $A_H$ more rapidly) corresponds to a larger angle φ and a more pronounced frustoconical contour of the inner surface 50. In other examples, a larger radius of curvature (i.e., a strap 12 that is closer to the conventional straight strap 100) corresponds to a smaller angle φ and an inner surface 50 that is closer to being cylindrical like that inner surface 110 of the conventional strap 100 in FIG. 5. The difference between the radii of curvature for the concave edge 46 and the convex edge 48 as well as the width W of the strap 12 will also affect the angle φ of the inner surface 50 that is created.

The radius of curvature of the concave edge 46 corresponds generally to the diameter of the inner surface 50 when it is smallest, which will be referred to as the "minor diameter $D_{Min}$ of the inner surface 50," the "inner surface minor diameter $D_{Min}$," or simply the "minor diameter $D_{Min}$" for brevity (shown in FIG. 4). The overall length L of the strap 12 will also dictate the minor diameter $D_{Min}$ as well. A smaller radius of curvature for the concave edge 46 will tend to result in a smaller inner surface minor diameter $D_{Min}$, while a larger radius of curvature for the concave edge 46 will tend to result in a larger inner surface minor diameter $D_{Min}$. The radius of curvature of the convex edge 48 corresponds generally to the diameter of the inner surface 50 when it is largest, which will be referred to as the "major diameter $D_{Maj}$ of the inner surface 50," the "inner surface major diameter $D_{Maj}$," or simply the "major diameter $D_{Maj}$" for brevity (also shown in FIG. 4). The overall length L of the strap 12 will also dictate the major diameter $D_{Maj}$ as well. A smaller radius of curvature for the convex edge 48 will tend to result in a smaller inner surface major diameter $D_{Maj}$, while a larger radius of curvature for the convex edge 48 will tend to result in a larger inner surface major diameter $D_{Maj}$.

Parameters of the strap 12 other than the curvature parameters described can also be selected to affect the contour of the inner surface 50, and thus the fit of the wrist-worn article 10 onto the wearer's arm 2. Other parameters that may be selected and adjusted include, but are not limited to: the width W of the strap 12 (which can be constant or substantially constant along the length L of the strap 12 as shown in FIG. 1, or can vary at different points along the strap length L); the overall length L of the strap 12; the length $L_A$, $L_B$ of each strap section 22A, 22B; the length of the arcuate portion 40A, 40B of each strap section 22; the total (i.e., combined) overall length of all the arcuate portions 40A, 40B of the strap 12; or the thickness T of the strap 12 (which can be constant or substantially constant along both the length L and the width W of the strap 12, or can vary in thickness in one or both of the length or width directions of the strap 12).

Once the strap parameters are selected, for example by selecting one or more curvature properties that will result in the inner surface 50 having a contour shape that corresponds with a selected portion of the outer surface 4 of the wearer's arm 2, the step of making or selecting a strap 12 can, in some examples, include selecting one of a set of standardized straps, wherein the selected one of the set is the strap 12 having the strap parameters that most close matches or substantially matches the selected strap parameters. In some examples, the step of making or selecting the strap 12 includes manufacturing a strap 12 with the strap parameters that were selected, i.e., custom making the strap 12 with the selected strap parameters for the specific wearer.

Once the strap 12 having the one or more specified selected strap parameters (e.g., with the one or more specified selected curvature properties) has been made or received, the method can include coupling the strap 12 to the housing 14 of a wrist-worn article 10, such as the wristwatch 10 shown in FIGS. 1 and 4, or to any of the other wrist-worn articles described above such as a fitness tracking device, a smartwatch, a GPS device, another electronic, mechanical, or electromechanical device, or an ornamental article. The final wrist-worn article 10 can then be sold or delivered to the wearer for which the strap 12 had been fit by the method. In other examples, the step of coupling the strap 12 to the watch housing 14 can be outside of the scope of the method, i.e., because the custom fit strap 12 is being sold as a stand-alone product that is sold or delivered to the wearer, in which case the strap 12 can be coupled to the housing 14 by the wearer himself or herself or by someone who couples the strap 12 to the housing 14 for the wearer.

In some examples, coupling the strap 12 to the housing 14 can include using attachment hardware, such as the spring bars 43A, 43B or other hardware that connects the proximal ends 24A, 24B of the strap sections 22A, 22B to the housing 14 at the mounting locations 28A, 28B. Specific examples of mounting hardware or other mounting means would be readily known to those of skill in the art of making wrist-worn articles or accessories for wrist-worn articles. The wrist-worn article 10 and strap 12 of the present disclosure is not limited to any specific means of coupling the strap 12 to the housing 14.

Strap with Molded Inner Surface

Figure 6:
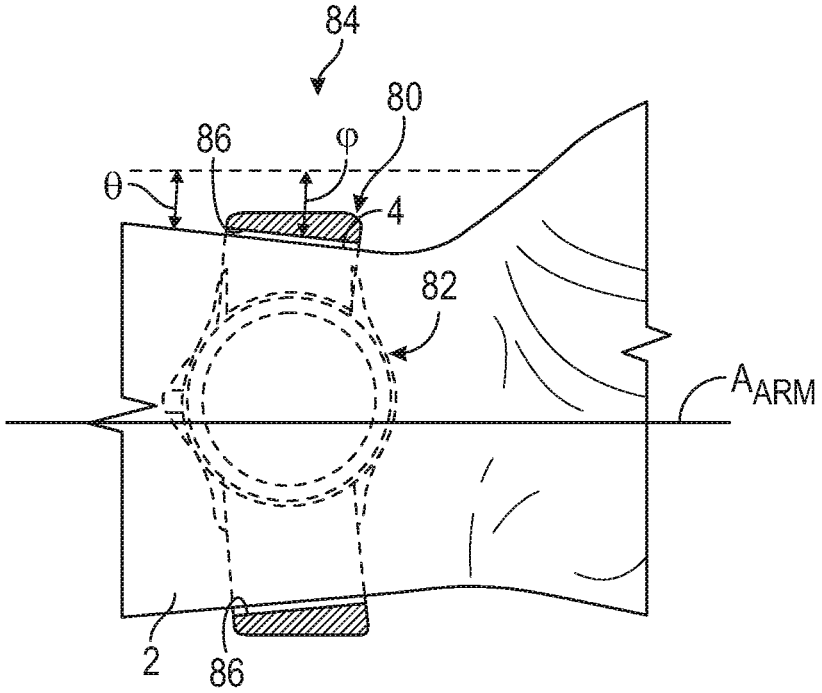
FIG. 6 is a cross-sectional view of another example strap for use with a wrist-worn article being worn on a wearer's arm.

The examples shown in FIGS. 1, 3, and 4 show a generally flat strap 12 that is configured to provide the inner surface 50 with the frustoconical or substantially frustoconical contour by including one or more arcuate portions 40A, 40B along at least a portion of the length of the strap 12, as described above. FIG. 6 shows a cross-sectional view of another example of a strap 80 fastened to a wearer's arm 2. Like the strap 12 and the strap 62 described above, the example strap 80 that can be connected to a housing 82 to form a wrist-worn article 84 that can be worn on the wearer's arm 2, as shown in FIG. 6.

The strap 80 shown in FIG. 6 is an example of another configuration that can provide an inner surface 86 with a contour that corresponds to the outer surface 4 of the wearer's arm 2, which, as described above, is generally frustoconical in shape. The example strap 80 shown in FIG. 6 provides a structure that provides for a generally frustoconical contour of at least a portion of the inner surface 86 of the strap 80 other than one or more arcuate portions as with the straps 12 and 60, described above. In an example, the inner surface 86 forms the angle φ relative to the arm axis $A_{Arm}$ that corresponds to the angle θ of the outer surface 4 of the wearer's arm 2, similar to the inner surface 50 of the strap 12 shown in FIG. 4. In an example, the angle φ of the inner surface 86 is equal to or substantially equal to the angle θ of the outer surface 4 of the arm 2 for at least a portion of the arm 2. In an example, the strap 80 is formed so that the inner surface 86 forms an angle φ with any one of the same angle values or range of values as those described above with respect to the inner surface 50 of the strap 12.

In an example, the strap 80 is formed by a manufacturing method that allows for the direct formation of the generally frustoconical contour of the inner surface 86 that corresponds to the outer surface 4 of the wearers arm 2 (e.g., that matches or substantially matches an outer contour of the outer surface 4). In some examples, the manufacturing method forms a frustoconical or substantially frustoconical contour for the inner surface 86 (e.g., the manufacturing method provides for the angle φ of the inner surface 86) so that the contour of the inner surface 86 matches or substantially matches the outer contour of the outer surface 4 (e.g., the manufacturing method molds the strap 80 so that the angle φ of the inner surface 86 is equal to or substantially equal to the angle θ of the outer surface 4). In an example, the manufacturing method can include molding a polymer or other moldable material (such as a resilient plastic, a natural or artificial rubber, or a blend thereof) into the shape of the strap 80, wherein the molding process includes molding the generally frustoconical inner surface 86. Manufacturing methods other than molding can be used to form the example strap 80 with the generally frustoconical inner surface 86. In an example, the molding or other manufacturing method used to form the strap 80 can include molding a compartment or other connection structure into the moldable material that can receive or otherwise engage with the housing 82 of the wrist-worn article 84 such that the molded strap 80 can be coupled to or engaged with the wrist-worn article housing 82 without the use of conventional watch-type connectors, such as spring bars and lugs or other fasteners.

In an example, the strap 80 can be molded (or formed by another manufacturing method) in the form of a straight or substantially straight strap that is aligned or substantially aligned with the housing axis $A_H$, e.g., that would look similar or identical to the straight strap 100 when the strap 80 is laid flat and viewed from above (as in FIG. 2). In other words, the strap 80 can be molded or otherwise shaped so that it appears to be substantially straight (e.g., aligned with the housing axis AO, but so that the inner surface 86 of the strap 80 has a contour that corresponds to the outer surface 4 of the wearer's arm 2. In other examples, the strap 80 can be molded or otherwise formed so that it includes one or more arcuate portions (similar to the one or more arcuate portions 40A and 40B of the strap 12) or angled lugs (similar to the lugs 72A and 72B in the wrist-worn article 60 shown in FIG. 3), or both, in addition to the inner surface 86 with a molded contour that corresponds to the outer arm surface 4, such as the angled inner surface 86. In this way, a designer of the strap 80 has options to select different geometric parameters for a particular strap. For example, if the design wished to make the strap 80 appear straight or aligned with the housing axis $A_H$, then the design could accordingly adjust the actual angle that is molded into the inner surface 86 to be steeper to compensate for the straight or aligned strap 80. In another example, a slight curvature for the one or more arcuate portions of the strap may be acceptable to the designer, but the designer may not wish to have the curve be as pronounced as is shown in FIG. 1 for the strap 10 that has a flat inner surface 50 (i.e., an inner surface that is coplanar or substantially coplanar with the general planar direction of the strap 10 when laid flat). The designer can therefore add an inner surface 86 that is slightly angled relative to the plane of the strap 80, although perhaps not as steep of an angle as is shown in FIG. 6 (which may be for a strap that was straight or substantially aligned with the housing axis $A_H$ when laid flat).

Articles for Other Parts of the Wearer's Body

The article 10 and the strap 12 are described above as being worn on an arm 2 of the wearer. While the inventor envisions wrist-worn articles 10 being the most common and likely area of the wearer's body for which the strap 12 of the present invention will be used, it will be recognized that the strap 12 and the methods of fitting a strap 12 are not limited only to articles that are worn on at or near a wearer's wrist 8. Rather, those of skill in the art will appreciate that the concepts of the strap 12 and the method of fitting a strap 12 described herein could also be applied to articles 10 that are worn on other parts of the body where articles can be strapped and for whatever reason that they are being strapped to the wearer. In particular, the concepts of the strap 12 and the method of fitting a strap 12 described above can be particularly useful for any part of a wearer's body that has an outer surface contour that is generally frustoconical in shape and/or that is conducive to the strap 12 being at least partially wrapped around a circumference of the body part that where the article 10 is being secured.

For example, the strap 12 of the present invention can be configured to secure an article 10 onto a wearer's leg, such as for a device or article that is to be worn on the lower leg (i.e., the calf) at or near the ankle. Similarly, the strap 12 can be configured for strapping an article 10 to the wearer's upper leg (i.e., the thigh), the wearer's upper arm (i.e., the biceps and triceps), the wearer's neck, one or more of the wearer's fingers, the wearer's hand (i.e., across the wearer's palm and the back of the wearer's hand), one or more of the wearer's toes, the wearer's foot (i.e., around the main portion of the wearer's foot over the arch and the top of the foot), or even to the wearer's waist or another part of the wearer's torso. In some examples, it may even be possible to configure the strap 12 for an article 10 that is fitted in an interior chamber within the wearer's body, i.e., for strapping the article 10 onto a portion of a wearer's bone, connective tissue, blood vessel or other fluid passageway, nerve, organ, or some other anatomical structure.

Similarly, although the strap 12 of the present invention is generally described above as being for a human wearer, the strap 12 and the article 10 is not limited only to articles 10 designed and configured for human anatomy. In addition, the strap 12 can be configured for an article 10 that is to be worn by another animal, including, but not limited to articles that are designed and configured for: domesticated animals, including pets (such as a dog or a cat), working animals (such as a horse, a donkey, a camel, or an elephant), or animals that are raised on a mass scale for other purposes, most notable those raised for the production of food or drink (such as cattle, chickens, pigs, goats, and the like); or for wild animals, such as for tracking or identification devices for wild animals in a zoo or that are being monitored for scientific or public interest purposes. As described above with respect to human articles 10, the strap 12 and the article 10 can be configured for wearing on any part of an animals body that is particular conductive to a strap that is wrapped around at least a portion of a circumference of the body part, and especially to body parts that have a generally or substantially frustoconical outer contour, such as an animals leg, arm or other upper appendage, neck, torso, tail, and the like. Also, as with an article 10 designed for a human wearer, a strap 12 and article 10 of the present invention can also be configured to be worn at or on an interior anatomical structure of the animal.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A wrist-worn article comprising:

a housing having a central axis, a first connective link at a first mounting location, and a second connective link at a second mounting location, wherein the second mounting location is on an opposite side of the housing from the first mounting location at the central axis and wherein the first connective link is parallel or substantially parallel to the second connective link and to the central axis;

a strapping structure including an inner surface, a first coupling structure coupled to the first connective link of the housing, and a second coupling structure coupled to the second connective link of the housing;

wherein a central axis of at least a portion of a strap of the strapping structure is arcuate relative to the central axis of the housing when the strap is laid flat to define a plane, the arcuate portion being in the plane such that the strap is curved in the plane, and wherein the arcuate shape of the strap causes the inner surface to form a frustoconical or substantially frustoconical contour corresponding to a portion of a user's arm while the strapping structure is coupled to the housing.

2. A wrist-worn article according to claim 1, wherein the strapping structure comprises a pair of cooperatively connectable strap sections, wherein the first coupling portion is on a first of the pair of strap sections and the second coupling portion is on a second of the pair of strap sections.

3. A wrist-worn article according to claim 2, wherein at least a portion of a length of each of the pair of strap sections is configured so that an inner strap section surface of each strap section forms a portion of the frustoconical or substantially frustoconical contour.

4. A wrist-worn article according to claim 3, wherein at least the portion of the length of each strap section is arcuate relative to the central axis when the strap section is laid flat or substantially flat, and wherein the portion of the length of each strap section that is arcuate is configured so that each inner strap section surface forms the portion of the frustoconical or substantially frustoconical contour.

5. A wrist-worn article according to claim 1, wherein the housing at least partially contains electronics or a mechanism for performing a function.

6. A wrist-worn article according to claim 5, wherein the function comprises at least one of: keeping time; tracking a position of the wrist-worn article; tracking a step count of the user; tracking a heart rate of the use; and a user interface between the user and a computing device.

7. A wrist-worn article according to claim 1, wherein the inner surface forms an angle relative to a central arm axis of from about 3° to about 5° when the wrist-worn article is configured to be worn on the arm of the user.

8. A wrist-worn article according to claim 1, wherein the portion of the length of the strapping structure that is arcuate has a radius of curvature when laid flat of from about 40 centimeters to about 60 centimeters.

* * * * *